US006256395B1

(12) United States Patent
Melanson

(10) Patent No.: US 6,256,395 B1
(45) Date of Patent: Jul. 3, 2001

(54) HEARING AID OUTPUT CLIPPING APPARATUS

(75) Inventor: John Laurence Melanson, Boulder, CO (US)

(73) Assignee: GN ReSound as (DK)

( * ) Notice: Subject to any disclaimer, the term of this patent is extended or adjusted under 35 U.S.C. 154(b) by 0 days.

(21) Appl. No.: 09/016,507

(22) Filed: Jan. 30, 1998

(51) Int. Cl.[7] ..... H04R 25/00

(52) U.S. Cl. ..... 381/312; 381/320; 381/321

(58) Field of Search ..... 381/312, 320, 381/321, 120, 121, 104–109, 102, 56–58; 364/400, 119

(56) References Cited

U.S. PATENT DOCUMENTS

| | | | | |
|---|---|---|---|---|
| 4,856,068 | * | 8/1989 | Quatieri | 381/47 |
| 4,876,542 | | 10/1989 | van Bavel | 341/143 |
| 4,977,403 | | 12/1990 | Larson | 341/143 |
| 5,008,675 | | 4/1991 | Toyomaki | 341/152 |
| 5,148,168 | | 9/1992 | Masuda et al. | 341/152 |
| 5,245,345 | | 9/1993 | Kohdaka et al. | 341/152 |
| 5,252,973 | | 10/1993 | Masuda | 341/131 |
| 5,406,284 | | 4/1995 | Lin et al. | 341/144 |
| 5,623,225 | * | 4/1997 | Traylor | 329/302 |
| 5,742,695 | * | 4/1998 | Suggs | 381/104 |
| 5,852,668 | * | 12/1998 | Ishige | 381/312 |
| 6,064,743 | * | 5/2000 | Suggs | 381/104 |

* cited by examiner

*Primary Examiner*—Huyen Le
*Assistant Examiner*—Dionne N. Harvey
(74) *Attorney, Agent, or Firm*—Jennifer L. Bales; Macheledt Bales & Johnson LLP

(57) ABSTRACT

A digital hearing aid applies clipping to the processed digital signal after at least part of the interpolation of the signal has occurred. The clipping may be incorporated into the output demodulation stage of the hearing aid. The final stages of interpolation may also be incorporated into the demodulation stage.

12 Claims, 20 Drawing Sheets

3/20

FIGURE 6 PRIOR

```
C PROGRAM TO SIMULATE A NOISE SHAPED, PWM DIGITAL TO ANALOG CONVERTER
WITH INTERPOLATING AND CLIPPING

JOHN MELANSON, 23 MAY 1996
ASSUMES AN INPUT SIGNAL, 16 BIT SIGNED INTEGER,
WITH +-16*1024 BEING THE INPUT SATURATION POINTS

OVERSAMPLING BY 4 AND CLIPPING PERFORMED IN THE CONVERTER.
IT IS ASSUMED THAT THE INPUT HAS ALREADY BEEN UPSAMPLED BY 4

THE PWM OUTPUT IS OPERATING AT 16 TIMES THE NOISE SHAPING FREQUENCY.

USES A NOISE SHAPER THAN CAN BE BUILT WITH ONE 3 PORT ADDER
(TWO 16 BIT INPUTS, ONE 10 BIT INPUT),
AND OPERATED IN FOUR PHASES.

THE DELTA SIGMA STRUCTURE USED IS ESPECIALLY APPROPRIATE,
AS IT OPERATES IN FOUR PHASES, AND IS VERY STINGY ON HARDWARE RESOURCES

THE CONVERTER IS ASSUMED TO BE OPERATING AT A 250 KHZ NOISE SHAPED
RATE, AND AT A 4 MHZ OUTPUT BIT RATE
```

```
#include <stdio.h>
#include <math.h>

double fs = 250000.;

// Feedback of quantized output

short   fb[17] = {

    0x4000,     //0
    0x3800,     //1
    0x3000,     //2
    0x2800,     //3
    0x2000,     //4
    0x1800,     //5
    0x1000,     //6
    0x0800,     //7
    0x0000,     //8
    0xf800,     //9
    0xf000,     //10
    0xe800,     //11
    0xe000,     //12
    0xd800,     //13
    0xd000,     //14
    0xc800,     //15
    0xc000,     //16
```

FIG. 12A

```
// CORRECTION FACTOR FOR SECOND INTEGRAL. NOTE THAT THE SIGN IS OPPOSITE
// THAT OF THE FEEDBACK, AS ODD OUTPUT WIDTHS ARE LATE RELATIVE TO
// EVEN OUTPUT WIDTHS

short cor[17] = {
    0x0000,    //0
    0x0040,    //1
    0x0000,    //2
    0x00c0,    //3
    0x0000,    //4
    0x0140,    //5
    0x0000,    //6
    0x01c0,    //7
    0x0000,    //8
    0x0240,    //9
    0x0000,    //10
    0x02c0,    //11
    0x0000,    //12
    0x0340,    //13
    0x0000,    //14
    0x03c0,    //15
    0x0000     //16

};

// ROM FOR DUTY CYCLE MODULATOR - PULSE
// GROWS FROM MIDDLE, ON RIGHT FIRST
//

short out_rom [17] [16] = {

    { -1, -1, -1, -1, -1, -1, -1, -1, -1, -1, -1, -1, -1, -1, -1, -1   //0
    { -1, -1, -1, -1, -1, -1, -1, -1, +1, -1, -1, -1, -1, -1, -1, -1}  //1
    { -1, -1, -1, -1, -1, -1, -1, +1, +1, -1, -1, -1, -1, -1, -1, -1}  //2
    { -1, -1, -1, -1, -1, -1, -1, +1, +1, +1, -1, -1, -1, -1, -1, -1}, //3
    { -1, -1, -1, -1, -1, -1, +1, +1, +1, +1, -1, -1, -1, -1, -1, -1}, //4
    { -1, -1, -1, -1, -1, -1, +1, +1, +1, +1, +1, -1, -1, -1, -1, -1}, //5
    { -1, -1, -1, -1, -1, +1, +1, +1, +1, +1, +1, -1, -1, -1, -1, -1}, //6
```

FIG. 12B

```
    {-1, -1, -1, -1, -1, +1, +1, +1, +1, +1, +1, +1, -1, -1, -1, -1}, //7
    {-1, -1, -1, -1, +1, +1, +1, +1, +1, +1, +1, +1, -1, -1, -1, -1}, //8
    {-1, -1, -1, -1, +1, +1, +1, +1, +1, +1, +1, +1, +1, -1, -1, -1}, //9
    {-1, -1, -1, +1, +1, +1, +1, +1, +1, +1, +1, +1, +1, -1, -1, -1}, //10
    {-1, -1, -1, +1, +1, +1, +1, +1, +1, +1, +1, +1, +1, +1, -1, -1}, //11
    {-1, -1, +1, +1, +1, +1, +1, +1, +1, +1, +1, +1, +1, +1, -1, -1}, //12
    {-1, -1, +1, +1, +1, +1, +1, +1, +1, +1, +1, +1, +1, +1, +1, -1}, //13
    {-1, +1, +1, +1, +1, +1, +1, +1, +1, +1, +1, +1, +1, +1, +1, -1}, //14
    {-1, +1, +1, +1, +1, +1, +1, +1, +1, +1, +1, +1, +1, +1, +1, +1}, //15
    {+1, +1, +1, +1, +1, +1, +1, +1, +1, +1, +1, +1, +1, +1, +1, +1} //16
};
```

```
add_3
EMULATE A 3 INPUT, 16 BIT ADDER (THE THIRD INPUT, C,
NEEDS TO BE ONLY 10 BITS).
HAS A CARRY INPUT
THE ADDER SATURATES ON OVERFLOW AND UNDERFLOW
```

```
short add_3 (short a, short b, short c, short carry) {
    long temp = (long) a + long (b) + long (c) + (carry ! = 0) ;
    if (temp > (signed) 0x0000ffffL) return 0x7fff;
    if (temp < (signed) 0xffff8000L) return 0x8000;
    return (short) temp;
}
```

```
quant
QUANTIZE A 16 BIT VALUE TO A NUMBER IN THE RANGE 0 - 16. OVER AND
UNDERFLOWS WILL PRODUCE VALUES OF 16 AND 0, RESPECTIVELY. A 0 INPUT
PRODUCES AN 8 OUTPUT, WHICH CORRESPONDS TO A 50% DUTY CYCLE
```

```
short quant (short x) {
    if (x > = (signed short) 0x4000) return 16;
    if (x < = (signed short) 0xc000) return 0;
    return (x + 0x4000) >> 11;
```

```
insig
MAKE A TEST SIGNAL, 2 KHZ, +- 10000 AMPLITUDE. THIS FUNCTION
WOULD NORMALLY BE REPLACED BY A SIGNAL SOURCE
FOLLOWED BY SOME KIND OF SAMPLE RATE INCREASING SYSTEM.

FOR DEMONSTRATION PURPOSES, SECOND WAVE WILL CLIP
```

FIG. 12C

```
#define testfreq 2000.
#define level 10000.

short insig( long time ) {
   if (time <= 125) {
      return (short) (.5 + level * sin (6.28318 / fs * testfreq * (long) time) );
   } else {
      return (short) (.5 + 2*level * sin (6.28318 / fs * testfreq * (long) time);
   }
}
```

```
                    bias
THE OUTPUT OF THIS ROUTINE COULD BE A SIMPLE 0x0400, BUT BETTER RESULTS
ARE HAD WITH A LITTLE BIT OF WHITE NOISE INJECTED.  WHITE NOISE COMES FROM
A RANDOM PRN
```

```
short bias (void) {
   static short r = 1 ;
   r = ( r << 1 ) | ( 1 & (( r >> 14 ) ^ ( r >> 13 )) ) ;
//
// return 0x300, 0x340, 0x380 . . . 0x6c0
//
   return ( r & 0x3c0 ) + 0x300;
}
```

```
                    main
EMULATE CONVERTER
TEST WILL RUN FOR 1000 US, TWO CYCLES OF THE TEST SINE WAVE
SECOND CYCLE OF SINE WILL CLIP
THE THREE PORTS OF THE ADDER ARE CONNECTED AS FOLLOWS
PORT     PHASE 0     PHASE 1     PHASE 2     PHASE 3
 a         r0          r0          r0          r0    (hard wired)
 b        in0/2       in1/2        r1          r1    (requires a 3 input mix)
 c      feedback       0        correction     bias   (requires simple logic)
carry    in0 1sb       0           0           0     (simple logic)
```

FIG. 12D

```
void main (void)  {
   short  r0 = 0;   // one of the hardware integrations registers
   short  r1 = 0;   // the other hardware integration register
   short out = 8;   // the previous output duty cycle
   short in0 = 0;   // input holding register, newest
   short in1 = 0;   // input holding register
   long  time;
   FILE *results;

   /* open an input file for update*/
   results = fopen ( "DAC.OUT", "w+") ;
   fprintf (results, "Output results of DAC simulation - 4MHz rate\n") ;

   for ( time = 0; time < 250; time ++) {
//
//  Update input register
//
/*
example of operation
time        input used
100         in (100) + in (96) /2
101         in (100) + in (96) /2
102         in (100) + in (100) /2
103         in (100) + in (100) /2

104         in (104) + in (100) /2
105         in (104) + in (100) /2
106         in (104) + in (104) /2
107         in (104) + in (104) /2

etc.  Pattern will repeat every 4 ticks
   if ( ( time % 2 ) == 0 ) in1 = in0 ;
   if ( ( time % 4 ) == 0 ) in0 = insig (time) ;
//
//  Do delta - sigma part
//
```

FIG. 12E

```
        r0 =          add_3 ( r0 ,     in0 >> 1  ,   fb [out] , in0 & 1 ) ; // phase 0
        r0 =          add_3 ( r0 ,     in1 >> 1  ,   0       , 0       ) ; // phase 1
        r1 =          add_3 ( r0 ,     rl        ,  cor[out] , 0       ) ; // phase 2
        out = quant( add_3 ( r0 ,      rl        ,  bias ( ) , 0       ) ) ; // phase 3
//
// Now do duty cycle modulator
//
        for ( int tick = 0 ; tick < 16 ; tick++ ) {
            fprintf ( results, " % + 4d", out_rom [out] [tick] ) ;
        }
        fprintf ( results, " \n" ) ;
        }
        fclose ( results) ;
}
```

Output results of DAC simulation – 4 MHz rate

| | | | | | | | | | | | | | | | |
|---|---|---|---|---|---|---|---|---|---|---|---|---|---|---|---|
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | -1 | -1 | -1 |
| -1 | -1 | +1 | +1 | +1 | +1 | +1 | +1 | +1 | +1 | +1 | +1 | +1 | +1 | -1 | -1 |

FIG. 12F

| | | | | | | | | | | | | | | | |
|---|---|---|---|---|---|---|---|---|---|---|---|---|---|---|---|
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | +1 | -1 |
| -1 | +1 | +1 | +1 | +1 | +1 | +1 | +1 | +1 | +1 | +1 | +1 | +1 | +1 | +1 | -1 |
| -1 | -1 | -1 | +1 | +1 | +1 | +1 | +1 | +1 | +1 | +1 | +1 | +1 | +1 | -1 | -1 |
| -1 | +1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | -1 | -1 |
| -1 | +1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | +1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | +1 | +1 | +1 | +1 | +1 | +1 | +1 | +1 | +1 | +1 | +1 | +1 | +1 | +1 | -1 |
| -1 | -1 | -1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | +1 | -1 |
| -1 | -1 | +1 | +1 | +1 | +1 | +1 | +1 | +1 | +1 | +1 | +1 | +1 | +1 | +1 | -1 |
| -1 | -1 | -1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | +1 | -1 | -1 |
| -1 | -1 | +1 | +1 | +1 | +1 | +1 | +1 | +1 | +1 | +1 | +1 | +1 | +1 | +1 | -1 |
| -1 | -1 | -1 | +1 | +1 | +1 | +1 | +1 | +1 | +1 | +1 | +1 | +1 | -1 | -1 | -1 |
| -1 | -1 | +1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | -1 | -1 | -1 |

FIG. 12G

| | | | | | | | | | | | | | | | |
|---|---|---|---|---|---|---|---|---|---|---|---|---|---|---|---|
| -1 | -1 | -1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | -1 | +1 | +1 | +1 | -1 | -1 | -1 | -1 | -1 | -1 |

FIG. 12H

| | | | | | | | | | | | | | | | |
|---|---|---|---|---|---|---|---|---|---|---|---|---|---|---|---|
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | -1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | -1 | +1 | +1 | -1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | -1 | +1 | +1 | -1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | -1 | +1 | +1 | -1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | +1 | +1 | +1 | +1 | +1 | +1 | -1 | -1 | -1 | -1 | -1 |

FIG. 12I

| | | | | | | | | | | | | | | | |
|---|---|---|---|---|---|---|---|---|---|---|---|---|---|---|---|
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | -1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | +1 | +1 | +1 | +1 | +1 | +1 | +1 | +1 | +1 | +1 | -1 | -1 | -1 |
| -1 | -1 | +1 | +1 | +1 | +1 | +1 | +1 | +1 | +1 | +1 | +1 | +1 | +1 | +1 | -1 |
| -1 | -1 | -1 | +1 | +1 | +1 | +1 | +1 | +1 | +1 | +1 | +1 | +1 | +1 | -1 | -1 |
| -1 | +1 | +1 | +1 | +1 | +1 | +1 | +1 | +1 | +1 | +1 | +1 | +1 | +1 | +1 | -1 |
| -1 | -1 | -1 | +1 | +1 | +1 | +1 | +1 | +1 | +1 | +1 | +1 | +1 | +1 | -1 | -1 |
| -1 | +1 | +1 | +1 | +1 | +1 | +1 | +1 | +1 | +1 | +1 | +1 | +1 | +1 | +1 | +1 |
| -1 | -1 | +1 | +1 | +1 | +1 | +1 | +1 | +1 | +1 | +1 | +1 | +1 | +1 | +1 | -1 |
| -1 | +1 | +1 | +1 | +1 | +1 | +1 | +1 | +1 | +1 | +1 | +1 | +1 | +1 | +1 | -1 |
| -1 | +1 | +1 | +1 | +1 | +1 | +1 | +1 | +1 | +1 | +1 | +1 | +1 | +1 | +1 | +1 |
| -1 | +1 | +1 | +1 | +1 | +1 | +1 | +1 | +1 | +1 | +1 | +1 | +1 | +1 | +1 | +1 |
| -1 | +1 | +1 | +1 | +1 | +1 | +1 | +1 | +1 | +1 | +1 | +1 | +1 | +1 | +1 | -1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |

FIG. 12J

| | | | | | | | | | | | | | | | |
|---|---|---|---|---|---|---|---|---|---|---|---|---|---|---|---|
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| +1 | +1 | +1 | +1 | +1 | +1 | +1 | +1 | +1 | +1 | +1 | +1 | +1 | +1 | +1 | +1 |
| -1 | -1 | -1 | -1 | -1 | -1 | +1 | +1 | +1 | +1 | +1 | -1 | -1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | +1 | +1 | +1 | +1 | +1 | +1 | +1 | +1 | +1 | +1 | +1 | -1 | -1 |
| -1 | -1 | -1 | -1 | -1 | +1 | +1 | +1 | +1 | +1 | +1 | +1 | -1 | -1 | -1 | -1 |

FIG. 12K

| | | | | | | | | | | | | | | | |
|---|---|---|---|---|---|---|---|---|---|---|---|---|---|---|---|
| -1 | -1 | -1 | -1 | +1 | +1 | +1 | +1 | +1 | +1 | +1 | +1 | +1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | +1 | +1 | +1 | +1 | +1 | +1 | +1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | +1 | +1 | +1 | +1 | +1 | +1 | -1 | -1 | -1 | -1 | -1 |
| -1 | -1 | -1 | -1 | -1 | -1 | -1 | +1 | +1 | -1 | -1 | -1 | -1 | -1 | -1 | -1 |
| -1 | -1 | -1 | -1 | -1 | -1 | +1 | +1 | +1 | +1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | -1 | +1 | +1 | -1 | -1 | -1 | -1 | -1 | -1 | -1 |
| -1 | -1 | -1 | -1 | -1 | -1 | -1 | +1 | +1 | +1 | -1 | -1 | -1 | -1 | -1 | -1 |
| -1 | -1 | -1 | -1 | -1 | -1 | -1 | -1 | +1 | -1 | -1 | -1 | -1 | -1 | -1 | -1 |
| -1 | -1 | -1 | -1 | -1 | -1 | -1 | -1 | +1 | -1 | -1 | -1 | -1 | -1 | -1 | -1 |
| -1 | -1 | -1 | -1 | -1 | -1 | -1 | -1 | +1 | -1 | -1 | -1 | -1 | -1 | -1 | -1 |
| -1 | -1 | -1 | -1 | -1 | -1 | -1 | -1 | +1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | +1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |

FIG. 12L

| | | | | | | | | | | | | | | | |
|---|---|---|---|---|---|---|---|---|---|---|---|---|---|---|---|
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | -1 | -1 | -1 | -1 | -1 | -1 | -1 | -1 | -1 |
| -1 | -1 | -1 | -1 | -1 | -1 | -1 | +1 | +1 | +1 | +1 | -1 | -1 | -1 | -1 | -1 |
| -1 | -1 | -1 | +1 | +1 | +1 | +1 | +1 | +1 | +1 | +1 | +1 | +1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | -1 | -1 | +1 | +1 | +1 | +1 | +1 | -1 | -1 | -1 | -1 | -1 |
| -1 | -1 | -1 | -1 | +1 | +1 | +1 | +1 | +1 | +1 | +1 | +1 | -1 | -1 | -1 | -1 |
| -1 | -1 | -1 | -1 | -1 | -1 | +1 | +1 | +1 | +1 | +1 | -1 | -1 | -1 | -1 | -1 |

FIG. 12M

HEARING AID OUTPUT CLIPPING APPARATUS

Patent application Ser. No. 08/662,873, entitled "Delta Sigma PWM DAC to Reduce Switching" is incorporated herein by reference.

BACKGROUND OF THE INVENTION

1. Field of the Invention

The present invention relates to output clipping apparatus. More specifically, the present invention relates to output clipping apparatus for hearing aids.

2. Description of the Prior Art

FIG. 1 (prior art) shows an analog hearing aid having microphone 11 connected to sound processing 12, incorporating clipping 14 and connected to power amplifier 16 and a speaker 18. Analog hearing aids clip occasionally, as it is impossible to get sufficient maximum signal level in a low power device like a hearing aid without clipping. The amplifier itself may perform the clipping function. In an analog device, the distortion caused by output clipping is acceptable, because the distortion is mostly odd order harmonics and some inter-modulation products. In a digital hearing aid output, such as that shown in FIG. 2, the effects of clipping are much worse. In a typical digital hearing aid, the circuit of FIG. 2 replaces blocks 14, 16, and 18 of FIG. 1. The clipping in such a system will create distortion products which are not harmonics or inter-modulation components, but are instead entirely unrelated to the signal, and are thus acoustically very undesirable.

One possible solution to the problem of clipping in a digital hearing aid is to convert the signal to analog, and then amplify and clip in the analog domain. This would remove the offending distortions, but at the cost of requiring greater precision in the D/A converter. As there is gain after the converter, noise will be amplified, so the noise floor would have to be better. This approach would also eliminate the possibility of a class D output stage directly in the D/A converter.

A typical digital hearing aid such as that shown in FIG. 8 includes an output digital to analog converter as one component. FIG. 2 (prior art) shows an oversampling digital to analog (D/A) converter, which utilizes a second order delta sigma quantizer 70 and a one-bit D/A converter 71 as the demodulator 69, and a low pass filter 73 to remove the noise from the one-bit signal. In one specific example of the oversampling D/A converter of FIG. 2, the input signal xi, 60, consists of data encoded into 16 bit words at 16 kHz. In a conventional D/A converter, signal 60 is clipped by clipper 61, and then placed into a register 63 from which it is fed into a low pass filter 64 at 32 kHz, with each word repeated two times. The low pass filter would typically be of the finite impulse response type. The linear interpolator 66, which is also a type of low pass filter, inserts three new words between each pair of words from low pass filter 64, which raises the data rate to 128 kHz. These words are fed into a second register 67, which feeds each word into the demodulator 69, repeating each word eight times, resulting in a data rate of 1 MHz. The 1 MHz sample rate is a sufficiently high data rate so that the quantization noise which will be introduced into the signal is small, and the requirements of the analog smoothing filter are easily met. Output yi, 61, is an analog signal.

Techniques for increasing the sample rate, generally called interpolation, are well understood by those versed in the art. Most designs will utilize several stages of increase, with each successive stage being simpler in structure, and running at a faster rate.

This sort of structure is frequently used in audio applications. The output of demodulator 69 can sometimes be driven directly into amplifier 75 and speaker 77, because the speaker can act as a low pass filter. This configuration uses what is called class D output. Power dissipation in a class D stage has the potential for being very low, as the output transistors are always in either a fully shorted or open position, removing most resistive power consumption. The remaining power is dissipated by the switching of capacitance, which is equal to $C*V^2*F$. C, the capacitance being switched, is typically set by the parasitic capacitance of the output transducer and of the driver transistors. V, the voltage being switched, is set by the available supplies, and the required audio output. F, the average frequency of the output, can be varied by the designer. As F is made larger, the quality of the signal improves, but the power also increases.

An over-sampling digital to analog (D/A) converter like that of FIG. 2, which includes clipping prior to the interpolating and up sampling blocks and utilizes a second order delta sigma quantizer 70, and a low pass filter 71 to convert the data from the delta sigma quantizer 70 to analog signal yi, 61, is a very effective device. However, clipping the digital signal prior to interpolating and up sampling results in a large amount of unpleasant distortion.

FIG. 3 shows a common second order delta sigma quantizer, which might be used as delta sigma quantizer 70 in FIG. 2. Delta sigma modulation incorporates a noise-shaping technique whereby the noise of a quantizer (often one-bit) operating at a frequency much greater than the bandwidth is moved to frequencies not of interest in the output signal. A filter after the quantizer removes the out of band noise. The resulting system synthesizes a high resolution data converter, but is constructed from low resolution building blocks. A good overview of the theory of delta sigma modulation is given in Oversampling Delta-Sigma Data Converters, by Candy and Temes, IEEE Press, 1992.

In practice, delta sigma modulators are generally at least second order, because higher order modulators better reduce noise in the signal band, due to improved prediction of the in-band quantization error. Thus, the resulting signal to noise ratio is better. Second order delta sigma modulators are still relatively stable, and easy to design.

Input xi, 35, is added to feedback signal 54 by adder 38. The signal from adder 38 is fed into first accumulator 40, comprising delay 42 and adder 41. The output of accumulator 40 is added to feedback signal 54 and fed into second accumulator 44, comprising delay 47 and adder 45. The output of accumulator 44 goes into quantizer 50, modeled as error signal ei, 52, added to the input by adder 51. Quantized output 36 also feeds back as feedback signal 54. Quantizer 50 may quantize the signal into ones and zeroes (one-bit format) or into multiple levels.

A need remains in the art for clipping apparatus for use with a digital hearing aid which reduces distortion.

SUMMARY OF THE INVENTION

An object of the present invention is to provide clipping apparatus for use with a digital hearing aid which reduces distortion. The present invention improves distortion from clipping by moving the clipping step after the interpolation steps.

A digital hearing aid according to the present invention comprises a microphone for receiving an audio analog signal, an A/D converter for converting the analog signal into a digital signal, a digital signal processing stage for processing the digital signal, an interpolation stage for increasing the ample rate of the processed digital signal, a clipper for clipping the increased sample rate signal, a demodulation stage for converting the clipped digital signal into an analog signal, and a speaker.

Alternatively, the clipper could be incorporated into the demodulation stage. Such a demodulation stage includes a clipping delta sigma quantizer including a quantizer and at least one accumulator having an accumulator arithmetic element for adding a delayed output signal from the accumulator arithmetic element to an input signal provided to the accumulator arithmetic element, wherein the accumulator arithmetic element includes clipping means. The accumulator provides a signal to the quantizer which provides an output signal and a feedback signal to the accumulator, and the delta sigma modulator further includes a feedback arithmetic element for adding the feedback signal to the accumulator input signal. The demodulation stage also includes a digital to analog converter for converting the output signal from the quantizer to an analog signal and providing the analog signal to the speaker.

The clipping means might comprise a saturating clipper built into the accumulator arithmetic element, or it might comprise a saturating clipper attached to the output of the accumulator arithmetic element.

The demodulation stage might alternatively comprise a clipping delta sigma quantizer of at least second order including a quantizer and at least two accumulators having accumulator arithmetic elements for adding delayed output signals from the accumulator arithmetic elements to input signals provided to the accumulator arithmetic elements, wherein each accumulator arithmetic element includes clipping means, and the accumulators provide signals to the quantizer which provides an output signal and feedback signals to the accumulators, and the delta sigma modulator further includes feedback arithmetic elements for adding the feedback signals to the accumulator input signals. The demodulation stage also includes a digital to analog converter for converting the output signal from the quantizer to an analog signal and providing the analog signal to the speaker.

In this case, each clipping means might comprise a saturating clipper built into the associated accumulator arithmetic element, or each clipping means might comprise a saturating clipper attached to the output of the associated accumulator arithmetic element.

A single multiport adder operating in multiple phases may comprise the accumulator arithmetic elements and the feedback arithmetic elements. For example, the single multiport adder could comprise a three input adder operating in three phases.

More specifically, the three phases would be as follows. The first phase adds the input to the delta sigma modulator plus the previous output of the first stage plus the negative of the feedback. The second phase adds the current output of the first stage plus the previous output of the second stage. The third phase adds the current output of the first stage plus the current output of the second stage, and feeds the quantizer.

The delta sigma modulator may include means for interpolating the input signal to the demodulator, comprising means for dividing the input signal into a first signal and a second signal each having half the magnitude of the input signal, means for delaying the first signal, and means for combining the delayed first signal with the second signal.

A second order clipping delta sigma quantizer according to the present invention comprises means for applying an input signal to the delta sigma quantizer, a first accumulator comprising means for storing a previous value of the first accumulator's output, and first adder means for adding at least one other input to the previous value of the first accumulator's output, to form the first accumulator's current output, a second accumulator comprising means for storing a previous value of the second accumulator's output, and second adder means for adding at least one other input to the previous value of the second accumulator's output, to form the second accumulator's current output, a third adder for adding at least two inputs to form a third adder output, and a quantizer for quantizing the third adder output to generate a feedback signal and an output signal, wherein the other inputs to the first accumulator comprise the feedback signal and the input signal, the other input to the second accumulator comprises the current output of the first accumulator, and the inputs to the third adder comprise the current output of the first accumulator fed forward and the current output of the second accumulator; and wherein the first adder, the second adder, and the third adder each include a clipping means.

As above, each clipping means may comprise a saturating clipper built into the associated adder, or a saturating clipper attached to the output of the associated adder.

A digital to analog (D/A) converter for converting a medium rate, high resolution digital signal into an analog signal according to the present invention comprises a delta sigma modulator of at least second order including at least two feedback loops carrying a feedback signal for converting the medium rate, high resolution digital signal into a medium rate, medium resolution digital signal, a duty cycle demodulator connected to the delta sigma modulator for converting the medium rate, medium resolution digital signal into a high rate, low resolution digital signal, and D/A means connected to the duty cycle demodulator for converting the high rate, low resolution digital signal into the analog signal. The duty cycle demodulator includes means for formatting the high rate, low resolution digital signal into a predetermined low transition rate format. The delta sigma modulator includes a quantizer, at least two accumulators having accumulator arithmetic elements for adding delayed output signals from the accumulator arithmetic elements to input signals provided to the accumulator arithmetic elements, wherein each accumulator arithmetic element includes clipping means, and the accumulators provide signals to the quantizer, which provides an output signal and the feedback signals to the accumulators, and the delta sigma modulator further includes feedback arithmetic elements for adding the feedback signals to the accumulator input signals, means for selecting a correction factor to be applied to at least one of the feedback loops based upon the predetermined low transition rate format and the feedback signal, and means for applying the correction factor to at least one of the feedback loops.

Each clipping means may comprise a saturating clipper built into the associated accumulator arithmetic element, or a saturating clipper attached to the output of the associated accumulator arithmetic element.

BRIEF DESCRIPTION OF THE DRAWINGS

FIG. 12 provides a C program simulation of circuitry including the demodulator of FIG. 7, incorporating clipping and the last two stages of up sampling in the demodulator.

DETAILED DESCRIPTION OF THE PREFERRED EMBODIMENT

Figure 1:
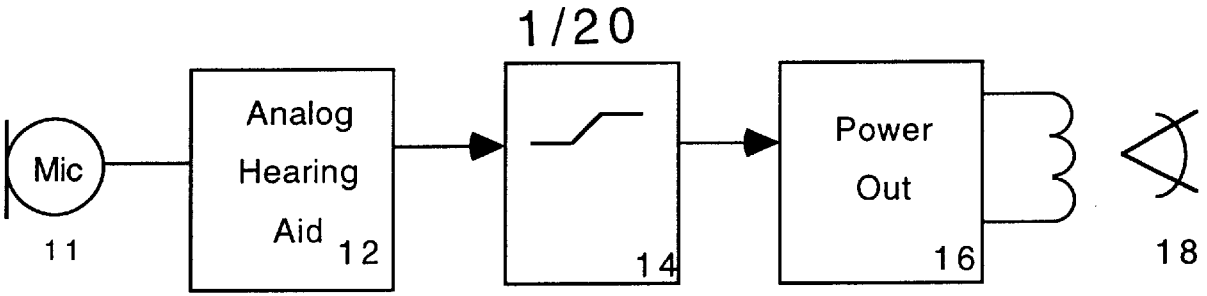
FIGURE 1 PRIOR ART
FIG. 1 (prior art) shows a conventional analog hearing aid with output clipping.
Figure 2:
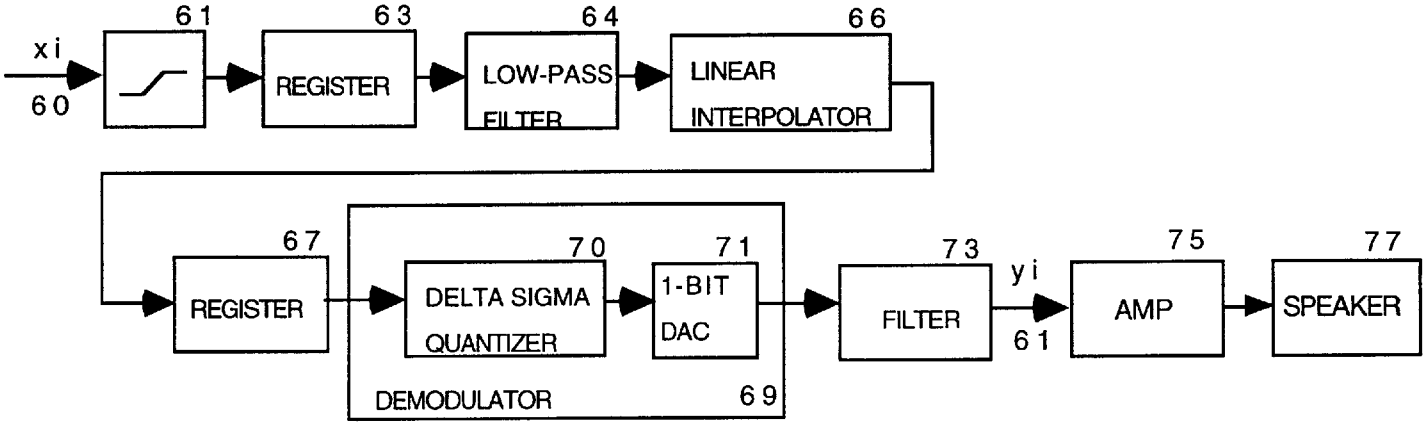
FIGURE 2 PRIOR ART
FIG. 2 (prior art) shows a conventional over-sampling D/A converter system, which clips the digital signal prior to interpolating and up sampling, and utilizes a second order delta sigma quantizer and a one-bit D/A converter as the demodulator.
Figure 4:
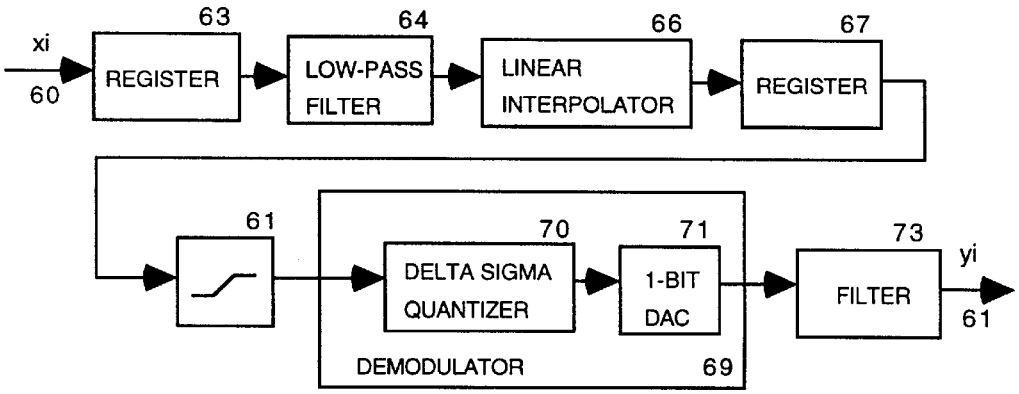
FIG. 4 shows an over-sampling D/A converter system according to the present invention, which clips the digital signal after interpolating and up sampling, and utilizes a second order delta sigma quantizer and a one-bit D/A converter as the demodulator.

FIG. 4 shows an oversampling digital to analog (D/A) converter very similar to that shown in FIG. 2, except that clipper 61 has been moved from its previous location prior to register 63 into a new location, after register 67. In other words, clipping is accomplished after interpolation rather than prior to interpolation. In order for this to be effective, the number of bits of resolution required in the interpolator must be increased to represent the increase in dynamic range. One extra bit, or 6 dB, has been found to be adequate for the hearing aid application. There is a noticeable improvement with even 3 dB.

Figure 11:
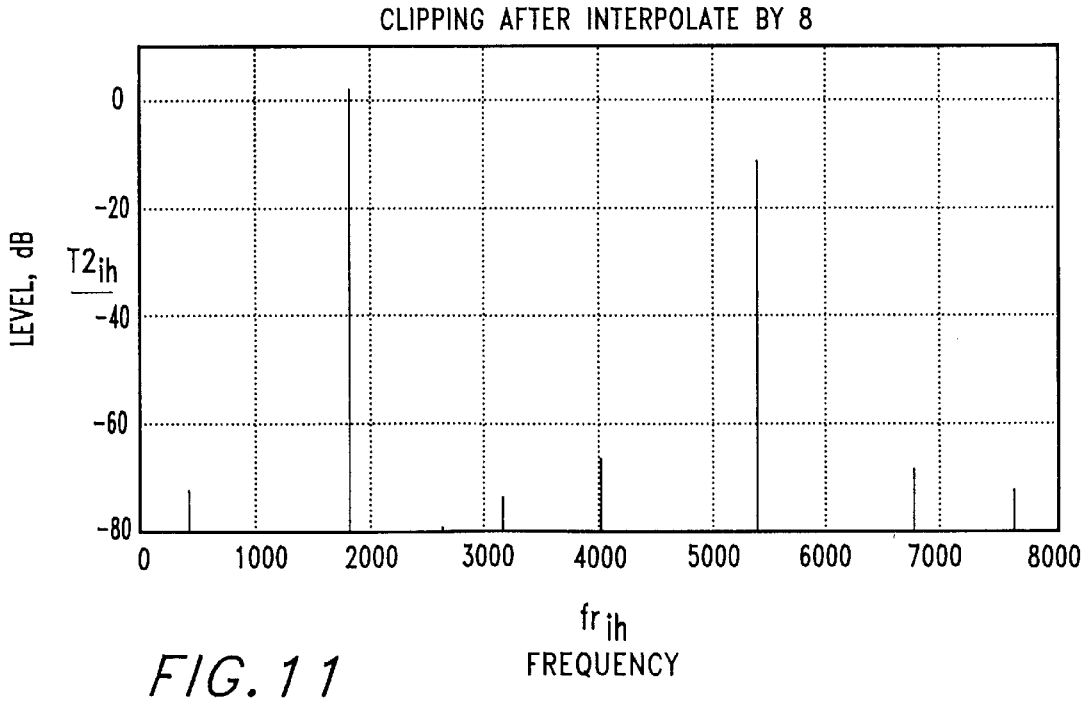
FIG. 11 shows the output signal of the circuitry of FIG. 4, utilizing clipping after interpolation/up sampling.

The undesirable distortion of clipping is due to the aliasing, or folding, of the harmonics produced by the clipping, by the sample rate of the system. If the ratio between the highest signal frequency and the sample rate is high when the clipping is performed, fewer of the undesirable aliases can occur. As the ratio approaches infinity, the effect becomes equivalent to that of an analog clipper. It has been determined that increasing the sampling rate by 8 or more before clipping produces a sound equivalent for most purposes to the analog system. A increase of 2 before clipping is noticeably inferior to analog clipping, but still far higher sound quality than the prior art. FIG. 11 shows the performance of this circuit.

Figure 3:
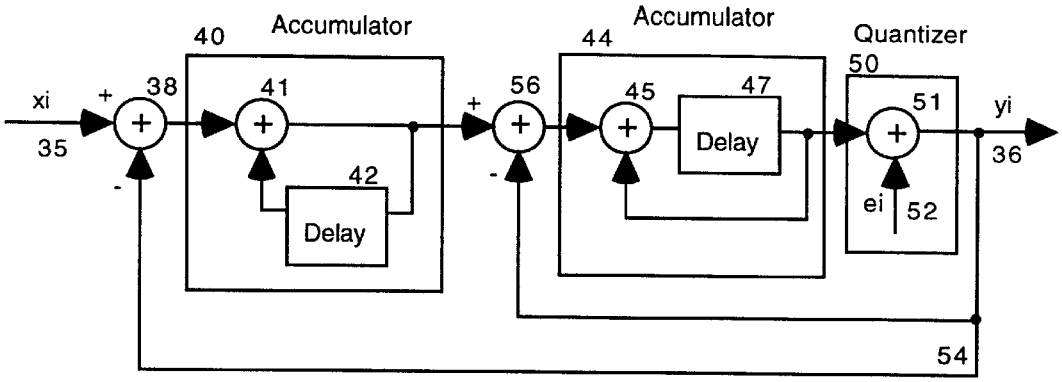
FIGURE 3 PRIOR ART
FIG. 3 (prior art) shows a common second order delta sigma quantizer.
Figure 5:
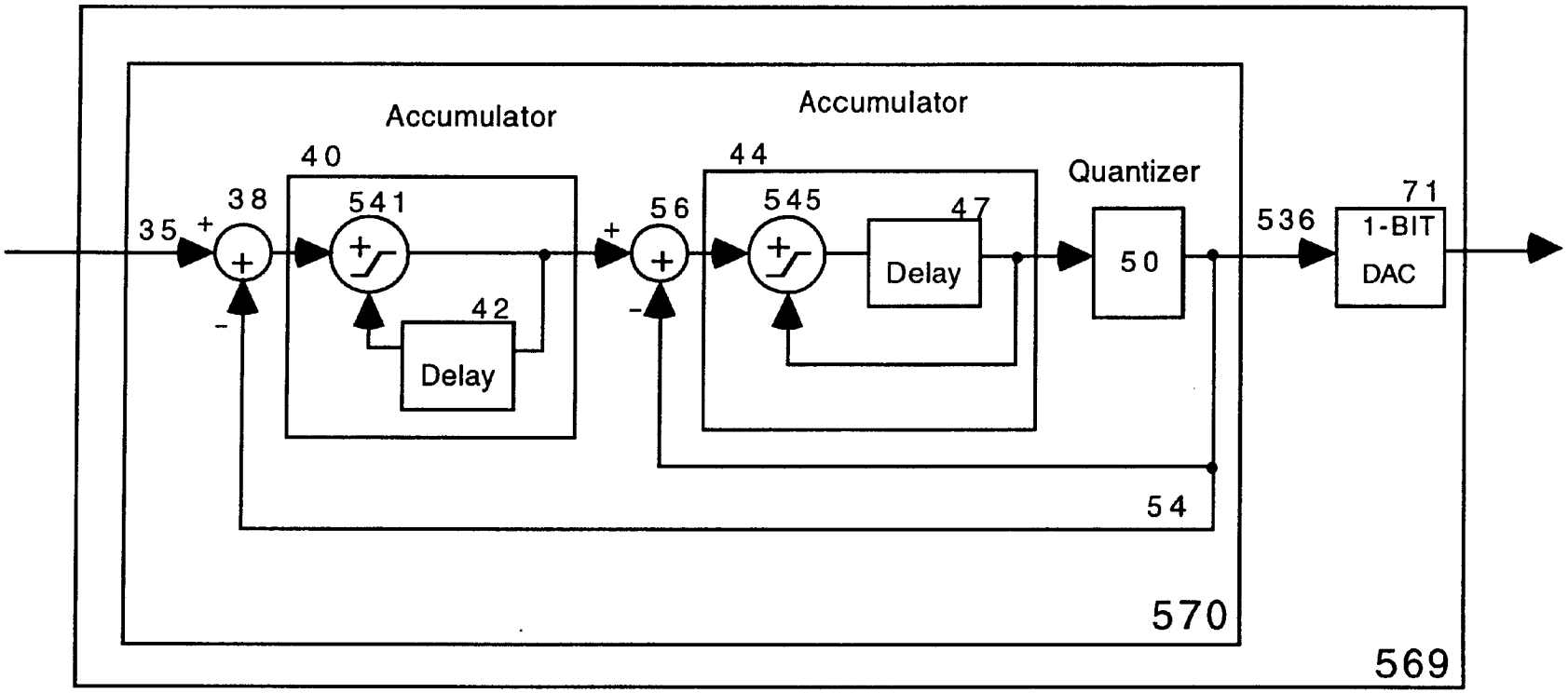
FIG. 5 shows a second embodiment of the present invention, which incorporates clipping into the delta sigma quantizer of the demodulator.

FIG. 5 shows a second embodiment of the present invention, which incorporates clipping into the delta sigma quantizer of the demodulator. The delta sigma quantizer of FIG. 5 is very similar to that shown in FIG. 3, except that adders 41 and 45 have bee replaced with clipping adders 541 and 545. Clipping adders 541 and 545 are simply adders having a clipping function built in. I.e., each adder clips the lowest few significant bits from the sum it outputs. Alternatively, the clipping function could be performed after each adder 541, 545, in a separate block.

Figure 6:
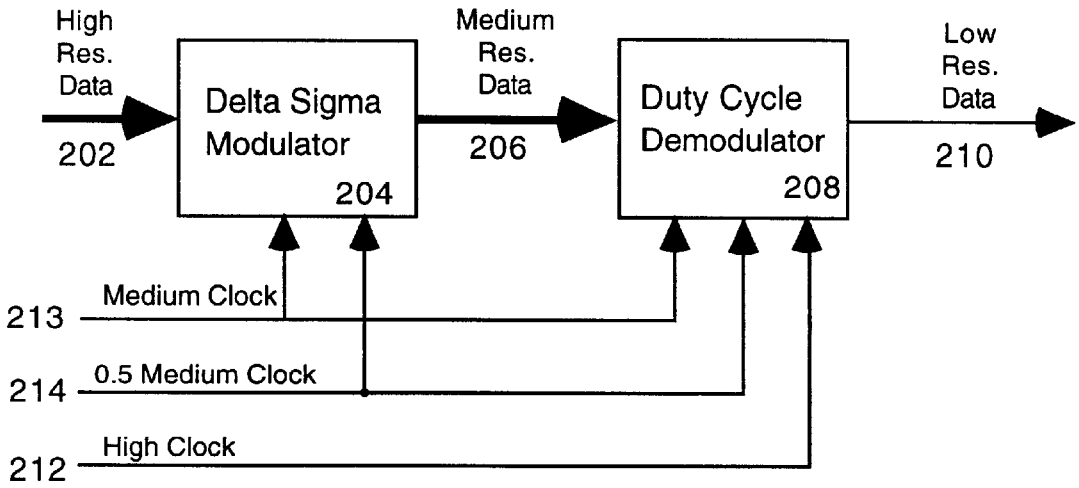
FIG. 6 (prior art) shows a demodulator including a delta sigma data converter and a duty cycle demodulator.

FIG. 6 (prior art) shows a demodulator which might be used in an over-sampling D/A converter such as the one shown in FIG. 4, replacing demodulator 69 in that Figure. This demodulator was disclosed in patent application Ser. No. 08/662,873, entitled D/A Converter Providing Low Output Data Transition Rates, incorporated herein by reference. A brief description will be given here for convenience. High resolution data 202, for example 12 to 20 bit data, enters delta sigma converter 204. The sample rate of this data has already been increased by interpolation from the low rate clock required to code the data, to a medium rate clock used to clock the delta sigma converter. The ratio of the low to the medium clock will typically be a factor of 32 to 1024, for example a low clock of 16 kHz to a medium clock of 1 MHz. Delta sigma modulator 204 is clocked by medium clock 213, for example at 1 MHz, to generate medium resolution data 206 (2 to 5 bit for example). Duty cycle demodulator 208 is clocked by medium clock 213 and high clock 212. The frequency of the high clock is a multiple of the medium clock, for example 16 MHz. The output of duty cycle demodulator 208 is low resolution data 210, typically in one or two bit format, at the high clock rate.

The optional 0.5 medium clock 214 is used for alternating output data formats. When two different output formats are used in alternating fashion, the 0.5 medium clock rate selects one of the formats for every other data frame output. Delta sigma modulator 204 also uses 0.5 medium clock 214 for the alternating case, because a different correction factor will be used depending upon which output format is being applied.

Figure 7:
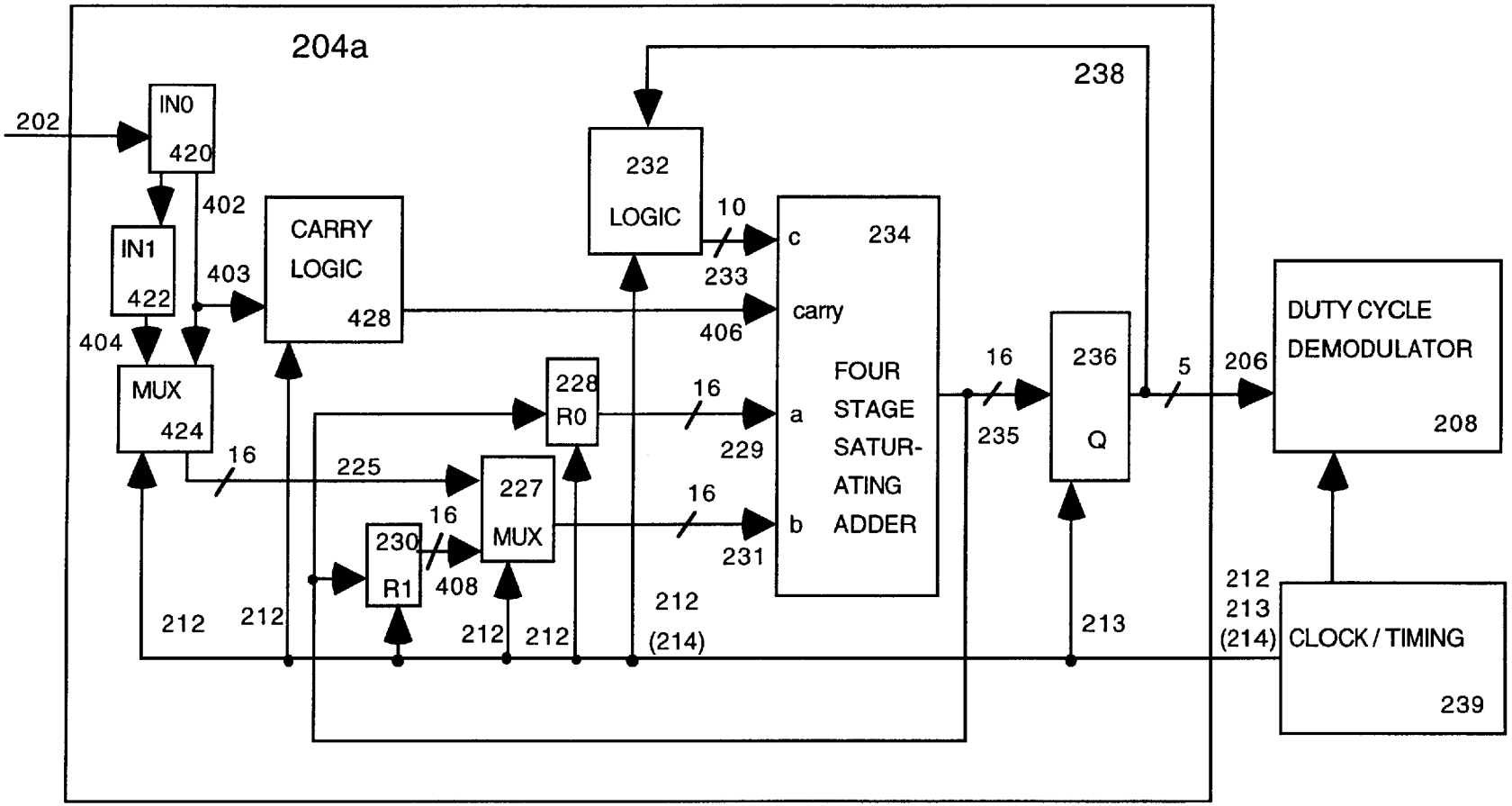
FIG. 7 shows a demodulator comprising a third embodiment of the present invention, wherein the clipping and the last two stages of up sampling are included in the demodulator.

FIG. 7 shows a demodulator in accordance with the present invention, wherein the clipping and the last two stages of up sampling are included in the delta sigma quantizer block 204*a*. This particular implementation is especially appropriate for use with a duty cycle demodulator, as the mathematics are performed in multiple phases. It incorporates the clipping step into saturating adder 234. It also incorporates the final two stages of up sampling, although this is optional. Thus the apparatus shown in FIG. 6 replaces clipper 61 and demodulator 69 in FIG. 4, and optionally replaces linear interpolator 66 and register 67. The demodulator of FIG. 7 has been simulated by a C program shown in FIG. 12.

In one specific example, high resolution data 202 is sixteen bits. Delta sigma modulator 204*a* outputs medium resolution data 206, in this case five bits of data corresponding to 17 levels, to duty cycle demodulator 208. High clock 212 is used by delta sigma modulator 204*a* of FIG. 7, to implement four stage adder 234, as described below.

High resolution data 202 is input into a register IN0 420, which transfers the data simultaneously to multiplexor 424 and register IN1 422. The least significant bit (LSB) 403 of the data from IN0 is also transferred to carry logic block 428. The circuitry comprising blocks 420, 422, and 424 performs a simple linear interpolation. The output of register 422 is the second input to multiplexor 424. Multiplexor 424 alternates between outputting the input from IN0 420 and the input from IN1 422, in both cases divided by 2 (a binary right shift of one). Carry logic 428 adds the LSB 403 lost in the above operation to guarantee that proper rounding occurs. The output 225 of multiplexor 424 is input to MUX 227.

The circuit of FIG. 7 is very efficient, because it utilizes one three input adder (with carry) 234 to implement all of the adders of the delta sigma quantizer. In addition, it accomplishes the linear interpolation step by alternately adding in half of the present input data and half of the previous input data. The effective linear interpolation sequence would be:

(in[0]+in[0])/2

(in[0]+in[1])/2

(in[1]+in[1])/2

(in[1]+in[2])/2

(in[2]+in[2])/2

(in[2]+in[3])/2

Carry logic 428 causes the data from register 420 to round up, and the data from register 422 to round down. In this way, no truncation error is introduced by the interpolation. Three input adder 234 operates as follows:

| | Phase 0 | Phase 1 | Phase 2 | Phase 3 |
|---|---|---|---|---|
| a | 229 | 229 | 229 | 229 |
| b | IN1/2 | IN1/2 | 408 | 408 |
| c | −238 | 0 | correction | bias + dither |
| carry | IN0 lsb | 0 | 0 | 0 |

Thus, delta sigma modulator 204*a* of FIG. 7 steps through the four adder stages (or phases) as follows. Adder phase 0 has as its inputs: signal 229, which is hardwired into adder 234 for all adding phases and comprises signal 235 passed through register 228; current high resolution input data IN0 divided by two, selected by MUX 424 and MUX 227 to be signal 231; feedback signal 238 selected and passed to adder 234 as signal 233 by logic block 232; and the least significant bit 403 of IN0, which is selected and passed to adder 234 as signal 406 by logic block 428.

Adder phase 1 has as its inputs: signal 229; high resolution input data IN1 divided by two, selected by MUX 424 and MUX 227; 0 (selected by logic block 232); and 0 (selected by logic block 428).

Adder phase 2 has as its inputs: signal 229; signal 408, which is signal 235 passed through register 230 and selected by MUX 227 as signal 231; a correction signal generated by logic block 232 and provided as signal 233; and 0 (selected by logic block 428).

Adder phase 3 has as its inputs: 229; signal 408 selected by MUX 227 as signal 231; a dither signal to prevent the system from generating tones plus a bias signal (if used) formed by logic 232 and passed to adder 234 as signal 233; and 0 (selected by logic block 428). Since the results of this adder stage 3 will be output, register 236 accepts the sixteen bit output signal 235 from adder 234 and quantizes it, outputting it as medium resolution (5 bit) data 206, to duty cycle demodulator 208.

The function is algorithmically:

$$r0=r0+\text{floor}((in0+1)/2)-Q \qquad \text{phase 0}$$

$$r0=r0+\text{floor}(in1/2) \qquad \text{phase 1}$$

$$r1=r0+r1+\text{correction}(Q) \qquad \text{phase 2}$$

$$Q=\text{quantize}(r0+r1+\text{bias}+\text{dither}) \qquad \text{phase 3}$$

(where "floor" is the proper name for the "integer part of" function. E.g. floor(3.2) is 3)

where the quantize operation consists of saving only the upper bits (typically 3–6) of the output of the summer.

Figure 8:
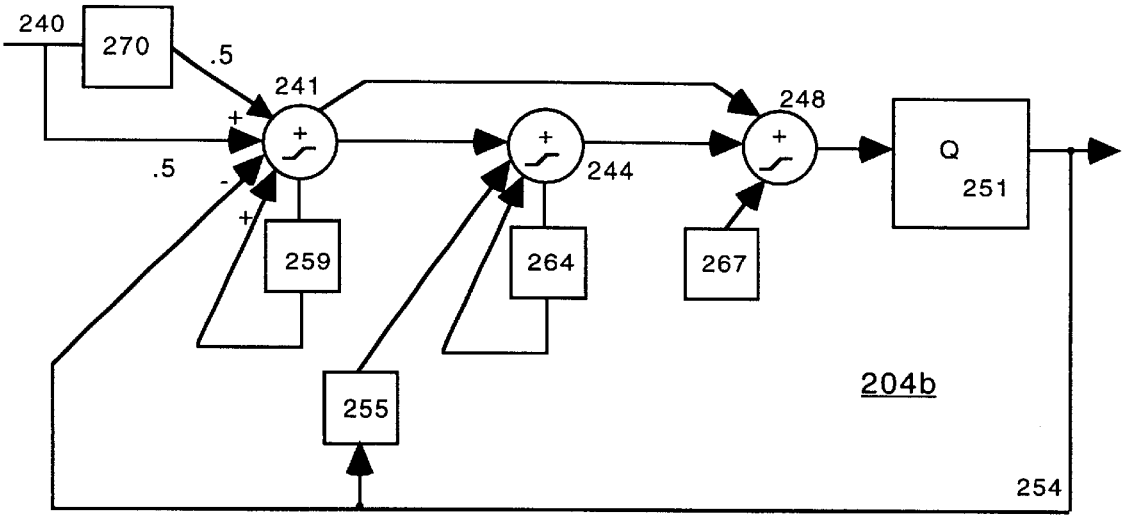
FIG. 8 shows a signal flow graph of a delta sigma modulator for use in a fourth embodiment of the present invention.

A more functional description of the four phases would be that phase 0 and phase 1 implement the last stage of interpolation, along with the first adder and accumulator of a second order delta sigma modulator; phase 2 implements the second adder and accumulator along with correction for the output data format; and phase 3 combines the output of the first two adder/accumulators together with bias and dither. Three input adder 234 has a saturating clipper built in, to accomplish the clipping function. Alternatively, clipping could be accomplished by a separate clipping block between adder 234 and quantizer 236. FIG. 8, described in more detail below, shows a signal flow graph of a delta sigma quantizer 204*b* which performs the same functions as 204*a*.

Clock and timing block 239 provides medium clock 213, 0.5 medium clock 214 (if used) and high clock 212. In FIG. 6, only medium clock 213 (and 0.5 medium clock 214, if used) are needed by conventional delta sigma modulator 204, because each adder is implemented separately, and none need to operate at a higher rate than the medium clock. For delta sigma modulator 204*a* of FIG. 7, however, signals derived from high clock 212 are required by multiplexor (MUX) 227, register 228 and 230, and logic 232, in order to fit four stages of adding into the timeline allowed for one frame of output data. Quantizer 236 only requires medium clock 213. If 0.5 medium clock 214 is used (because the format applied by duty cycle demodulator 208 alternates, requiring correction logic within logic block 232 to alternate) 0.5 medium clock 214 is provided to logic block 232 and to duty cycle demodulator 208.

Obviously, high clock 212 runs at a higher rate than is required to have four adding stages. Up to sixteen adding stages could operate within delta sigma modulator 204*a*, if required, for example by a higher order delta sigma modulator. Any extra time phases are not used in this example, but could be used, for example, to calculate for additional channels of output.

FIG. 8 shows a signal flow graph of delta sigma modulator 204*b*, which performs the same functions as 204*a* of FIG. 7. While the operation of delta sigma modulator 204*b* is not as simple and efficient as that of 204*a*, it performs the same functions and has the same improved signal quality. Delay 270, combined with halving the direct and delayed signals 240 implements the interpolation phase. Clipping adder 241, along with delay 259 implements the first accumulator, and also adds in feedback signal 254. Clipping adder 244, along with delay 264, implements the second accumulator and adds in feedback signal 254 fed through correction block 255. Clipping adder 248 combines the fed forward results of adder 241 and the results of adder 244 with a dither and/or bias signal 267. Quantizer 251 quantizes the output signal. As in the case of delta sigma modulator 204*a* of FIG. 7, clipping is accomplished in adders 241, 244, and 248, which have saturating clippers built in, to accomplish the clipping function. Alternatively, clipping could be accomplished by separate clipping blocks following each adder 241, 244, and 248.

Figure 9:
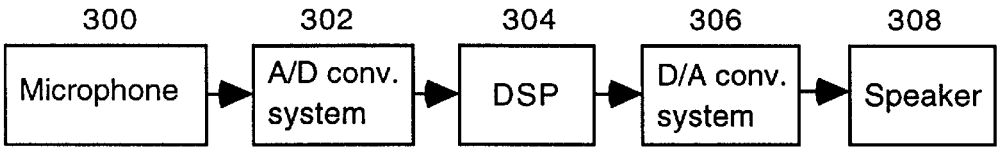
FIG. 9 shows a hearing aid utilizing improved clipping in the D/A conversion system according to the present invention.

FIG. 9 shows a hearing aid comprising a microphone 300, an A/D conversion system 302, digital signal processing (DSP) 304, a D/A conversion system 306, and a speaker 308. The components of the hearing aid of FIG. 9 are conventional and well understood, except that D/A conversion system 306 has been modified in accordance with the present invention. In the preferred embodiment, D/A conversion system 306 is an over-sampling D/A conversion system such as that shown in FIG. 4, where demodulator 69 has been replaced with the demodulator of FIG. 5, FIG. 7, or FIG. 8, which incorporates the clipping function.

Figure 10:
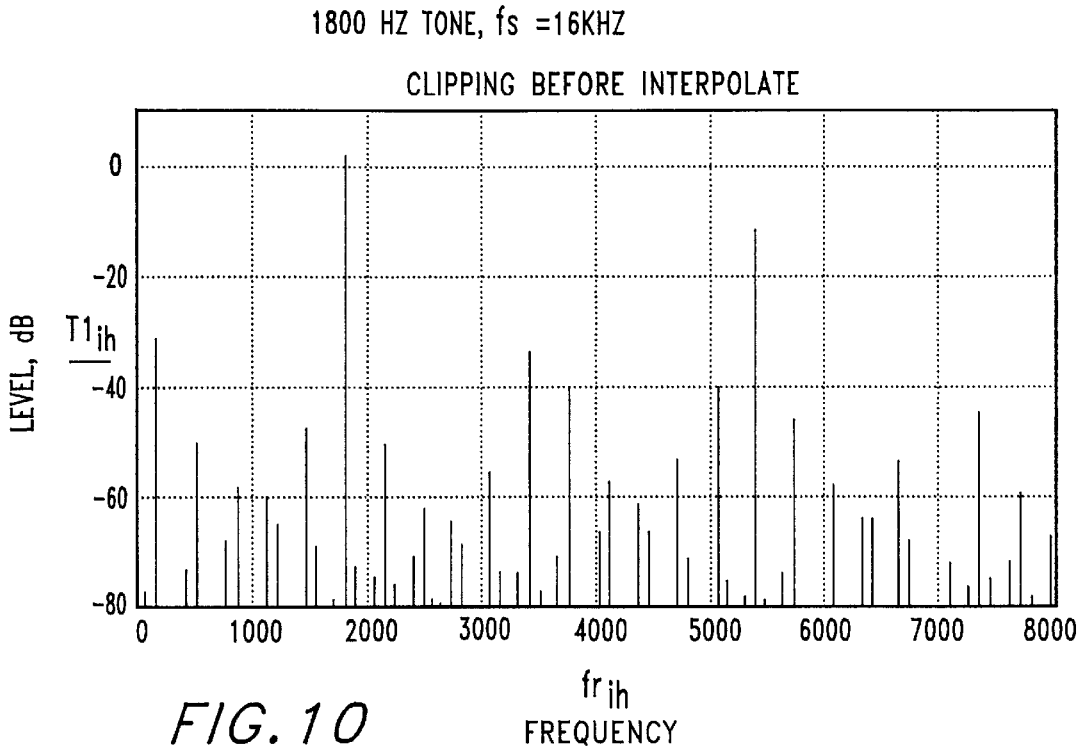
FIG. 10 shows the output signal of the conventional circuitry of FIG. 2, utilizing clipping before interpolation/up sampling.

FIG. 10 shows the output signal of a conventional demodulator, as is shown in FIG. 2, utilizing clipping before interpolation/up sampling.

FIG. 11 shows the output signal of the demodulator of FIG. 4, utilizing clipping after interpolation/up sampling.

FIG. 12 provides a C program simulation of circuitry including the demodulator of FIG. 7, which incorporates some interpolation and clipping. In order, the sections of the C program show initialization, implementation of a linear feedback function (part of logic block 232), a correction factor applied to the second order feedback (part of logic block 232), and optimized for the centered, growing to the right format, ROM 220 for duty cycle demodulator 208 (centered, growing to the right format), a three input and carry, sixteen bit adder 234 which saturates (overflows take the maximum value and underflows take the minimum value), quantizer 236 (which returns a value in the range 0 to 16), test signal generation (for signal 202), bias (or dither) generator (part of logic block 232), update of input register, alternating between IN0 and IN1; the four stages of adding which comprise the delta sigma modulator; and the duty cycle demodulator.

Arrays fb and cor show feedback and correction signals appropriate for the duty cycle modulator described by the array out_rom. It is understood by those versed in the art that adding a dither signal can improve the quality of the noise generated by delta sigma converter system, and is shown added in this program.

While the exemplary preferred embodiments of the present invention are described herein with particularity, those skilled in the art will appreciate various changes, additions, and applications other than those specifically mentioned, which are within the spirit and scope of this invention. In particular, it should be noted that, while the present invention has been discussed primarily in the context of a hearing aid, nearly any audio application can use this technique when clipping, or limiting, is desirable. Such an application must implement the following steps: increase the sample rate by n with an interpolator; clip (or other nonlinear processing); lowpass the signal; and downsample by n. This technique implements a generally valuable signal processing block for audio processing that, in effect, allows a digital system to accurately emulate a nonlinear analog system.

What is claimed is:

1. A digital hearing aid comprising:

a microphone for receiving an input audio signal and providing an analog signal;

an A/D converter connected to the microphone for receiving the analog signal, converting the analog signal to a digital signal, and providing the digital signal as an output;

a digital signal processing stage connected to the A/D converter for receiving the digital signal, processing the digital signal, and providing the processed digital signal as an output;

an interpolation stage for receiving the processed digital signal, increasing the sample rate of the processed digital signal, and providing the increased sample rate processed digital signal as an output;

a clipper connected to the output of the interpolation stage for receiving the increased sample rate processed digital signal, clipping the increased sample rate processed digital signal, and providing the clipped increased sample rate processed digital signal as an output;

a demodulation stage connected to the clipper for receiving the clipped increased sample rate processed digital signal, converting the clipped increased sample rate processed digital signal into an output analog signal, and providing the output analog signal as an output; and a speaker connected to the demodulation stage for receiving the output analog signal and providing an audio output signal based upon the output analog signal.

2. A digital hearing aid comprising:

a microphone for receiving an input audio signal and providing an analog signal;

an A/D converter connected to the microphone for receiving the analog signal, converting the analog signal to a digital signal, and providing the digital signal as an output;

a digital signal processing stage connected to the A/D converter for receiving the digital signal, processing the digital signal, and providing the processed digital signal as an output;

an interpolation stage for receiving the processed digital signal, increasing the sample rate of the processed digital signal, and providing the increased sample rate processed digital signal as an output;

a demodulation stage connected to the interpolation stage for receiving the increased sample rate processed digital signal, converting the increased sample rate processed digital signal into an output analog signal, and providing the output analog signal as an output; and a speaker connected to the demodulation stage for receiving the output analog signal and providing an audio output signal based upon the output analog signal;

wherein the demodulation stage includes means for clipping the increased sample rate processed digital signal prior to converting the increased sample rate processed digital signal into an analog signal.

3. The hearing aid of claim 2 wherein the demodulation stage comprises:

a clipping delta sigma quantizer including a quantizer and at least one accumulator having an accumulator arithmetic element for adding a delayed output signal from the accumulator arithmetic element to an input signal provided to the accumulator arithmetic element, wherein the accumulator arithmetic element includes clipping means, said accumulator providing a signal to the quantizer which provides an output signal and a feedback signal to the accumulator, said delta sigma modulator further including a feedback arithmetic element for adding said feedback signal to the accumulator input signal; and a digital to analog converter for converting the output signal from the quantizer to an analog signal and providing the analog signal to the speaker.

4. The hearing aid of claim 3, wherein the clipping means comprises a saturating clipper built into the accumulator arithmetic element.

5. The hearing aid of claim 3, wherein the clipping means comprises a saturating clipper attached to the output of the accumulator arithmetic element.

6. The hearing aid of claim 2, wherein the demodulation stage comprises:

a clipping delta sigma quantizer of at least second order including a quantizer and at least two accumulators having accumulator arithmetic elements for adding delayed output signals from the accumulator arithmetic elements to input signals provided to the accumulator arithmetic elements, wherein each said accumulator arithmetic element includes clipping means, said accumulators providing signals to the quantizer which provides an output signal and feedback signals to the accumulators, said delta sigma modulator further including feedback arithmetic elements for adding said feedback signals to the accumulator input signals; and a digital to analog converter for converting the output signal from the quantizer to an analog signal and providing the analog signal to the speaker.

7. The hearing aid of claim 6, wherein each clipping means comprises a saturating clipper built into the associated accumulator arithmetic element.

8. The hearing aid of claim 6, wherein each clipping means comprises a saturating clipper attached to the output of the associated accumulator arithmetic element.

9. The hearing aid of claim 6, wherein a single multiport adder operating in multiple phases comprises the accumulator arithmetic elements and the feedback arithmetic elements.

10. The delta sigma modulator of claim 9 wherein the single multiport adder comprises a three input adder operating in three phases.

11. The delta sigma modulator of claim 10 wherein the three phases comprise:

the first phase adds the input to the delta sigma modulator plus the previous output of the first stage plus the negative of the feedback;

the second phase adds the current output of the first stage plus the previous output of the second stage; and the third phase adds the current output of the first stage plus the current output of the second stage, and feeds the quantizer.

12. The delta sigma modulator of claim 9, further including means for interpolating the input signal to the demodulator comprising:

means for dividing the input signal into a first signal and a second signal each having half the magnitude of the input signal;

means for delaying the first signal; and means for combining the delayed first signal with the second signal.

* * * * *